US007561108B2

(12) United States Patent
Fu et al.

(10) Patent No.: US 7,561,108 B2
(45) Date of Patent: Jul. 14, 2009

(54) ANTENNA ARRAY CAPABLE OF REDUCING SIDE LOBE LEVEL

(75) Inventors: Kuo-Chan Fu, Taipei (TW); Tsung-Wen Chiu, Taipei (TW); Chen-Hsuan Hsu, Taipei (TW); Po-Sheng Chen, Taipei (TW); Fu-Ren Hsiao, Taipei (TW)

(73) Assignee: Advanced Connectek Inc., Taipei (TW)

( * ) Notice: Subject to any disclaimer, the term of this patent is extended or adjusted under 35 U.S.C. 154(b) by 196 days.

(21) Appl. No.: 11/781,277

(22) Filed: Jul. 23, 2007

(65) Prior Publication Data

US 2008/0048924 A1 Feb. 28, 2008

(30) Foreign Application Priority Data

Jul. 21, 2006 (TW) ..... 95126734 A

(51) Int. Cl.
*H01Q 1/38* (2006.01)

(52) U.S. Cl. ..... 343/700 MS; 343/841

(58) Field of Classification Search ..... 343/700 MS, 343/824, 841, 846
See application file for complete search history.

(56) References Cited

U.S. PATENT DOCUMENTS 4,460,894 A * 7/1984 Robin et al. ..... 343/700 MS
4,783,661 A * 11/1988 Smith ..... 343/700 MS
5,173,711 A * 12/1992 Takeuchi et al. ..... 343/700 MS
6,218,989 B1 * 4/2001 Schneider et al. ..... 343/700 MS
6,795,021 B2 * 9/2004 Ngai et al. ..... 343/700 MS

* cited by examiner

*Primary Examiner*—Michael C Wimer
(74) *Attorney, Agent, or Firm*—Jianq Chyun IP Office

(57) ABSTRACT

An antenna array unit is provided by the present invention. The antenna array unit includes: a ground, a feeder cable, a first signal feeding member, a plurality of second signal feeding members, a plurality of third signal feeding members, a plurality of first rectangular radiating members and a plurality of second rectangular radiating members. The first rectangular radiating members have first and second non-radiating sides, two radiating sides able to generate a coupling effect with a radiating side adjacent thereto. The second rectangular radiating members have first and second non-radiating sides, two radiating sides and able to generate a coupling effect with a radiating side adjacent thereto. The present invention is characterized in that at least one current disturbing member is formed at each non-radiating second side of the plurality of the first and the second rectangular radiating members and adjacent to the nearest radiating side generating the coupling effect.

6 Claims, 5 Drawing Sheets

ANTENNA ARRAY CAPABLE OF REDUCING SIDE LOBE LEVEL

CROSS-REFERENCE TO RELATED APPLICATION

This application claims the priority benefit of Taiwan application serial no. 95126734, filed Jul. 21, 2006. All disclosure of the Taiwan application is incorporated herein by reference.

BACKGROUND OF THE INVENTION

1. Field of Invention

The present invention relates to an antenna array applying to wireless communication products, and more particularly to an antenna array capable of reducing side lobe level.

2. Description of Related Art

Along with the rapid development of wireless communication at the present, a lot of demands for products become larger. In additional to achieve standards of electrical characteristic, each of appearance and convenience of the above products is toward various aspects. In several "point-to-point" wireless communication applications, it is necessary to use an antenna array accompanying with high gain. However, the antenna array with higher gain is eager to generate side lobe level. Unfortunately, the side lobe level not only reduces gain of the antenna array, but also interferes with the system. Therefore, in the design of an antenna array, it must take more emphasizes on how to reduce the side lobe level of the antenna array.

At present, the array antenna, applying to mobile communication manufactures, is provided with several radiating members of the same shape. FIG. 7 is a top view showing a conventional antenna array unit according to prior art. The conventional antenna array unit includes a ground 11 coupled to a negative signal wire, a plurality of radiating members 12 of the same shape, and a feeding network 13 for controlling amplitude and phase of the signal through each of the radiating members 12. The feeding network 13 includes a signal feeding member 131 coupled to a positive signal wire for transmitting the signal at high frequency.

With regard to the above design of the antenna array, the plurality of radiant metal plate is used for raising the antenna directivity, further increasing gain of the antenna array. However, it is not effective to reduce the side lobe, which interferes with the transmitting signal, and then the purpose and the use is restricted. Therefore, the target of the antenna array design relies on how to reduce side lobe level. The present invention is effective to reduce the side lobe level by adding the interface current disturbing elements and is able to be used in most industry applications.

SUMMARY OF THE INVENTION

The present invention is to provide a novel design of an antenna array for reducing side lobe. The antenna array unit includes a ground, a feeder cable, a first signal feeding member, a plurality of second signal feeding members, a plurality of third signal feeding members, a plurality of first rectangular radiating members, and a plurality of second rectangular radiating members. The first signal feeding member is connected to the ground and the feeder cable, and has two sides. Each of the plurality of second signal feeding members is connected to the first signal feeding member. Further, each of the plurality of third signal feeding members is connected to the first signal feeding member. The plurality of the first rectangular radiating members are arranged adjacent to one side of the first signal feeding member, each having a first non-radiating side connected to the corresponding second signal feeding member, a second non-radiating side, and two radiating sides, each connected to both the first and the second non-radiating sides and able to generate a coupling effect with a radiating side adjacent thereto. The plurality of second rectangular radiating members arranged adjacent to the other side of the first signal feeding member, each having a first non-radiating side connected to the corresponding third signal feeding member, a second non-radiating side, and two radiating sides, each respectively connected to the first and the second non-radiating sides and able to generate a coupling effect with a radiating side adjacent thereto.

The present invention is characterized in that at least one current disturbing member is formed at each second non-radiating side of the plurality of the first and the second rectangular radiating members and adjacent to the nearest radiating side generating the coupling effect.

As embodied and broadly described herein, all the current disturbing members form in pairs. Each of the current disturbing members may be polygonal. Further, each of the current disturbing members may be triangular or trapezoid. Furthermore, the first signal feeding member, a plurality of second signal feeding members, a plurality of third signal feeding members, and a feeder cable form a network.

The present invention is effective to eliminate the coupling effect between two neighbor radiating sides of the antenna array, further to reduce the side lobe level.

In order to make the aforementioned and other objects, features and advantages of the present invention comprehensible, preferred embodiments accompanied with figures are described in details below.

BRIEF DESCRIPTION OF THE DRAWINGS

The accompanying drawings are included to provide a further understanding of the invention, and are incorporated in and constitute a part of this specification.

DESCRIPTION OF EMBODIMENTS

Figure 1:
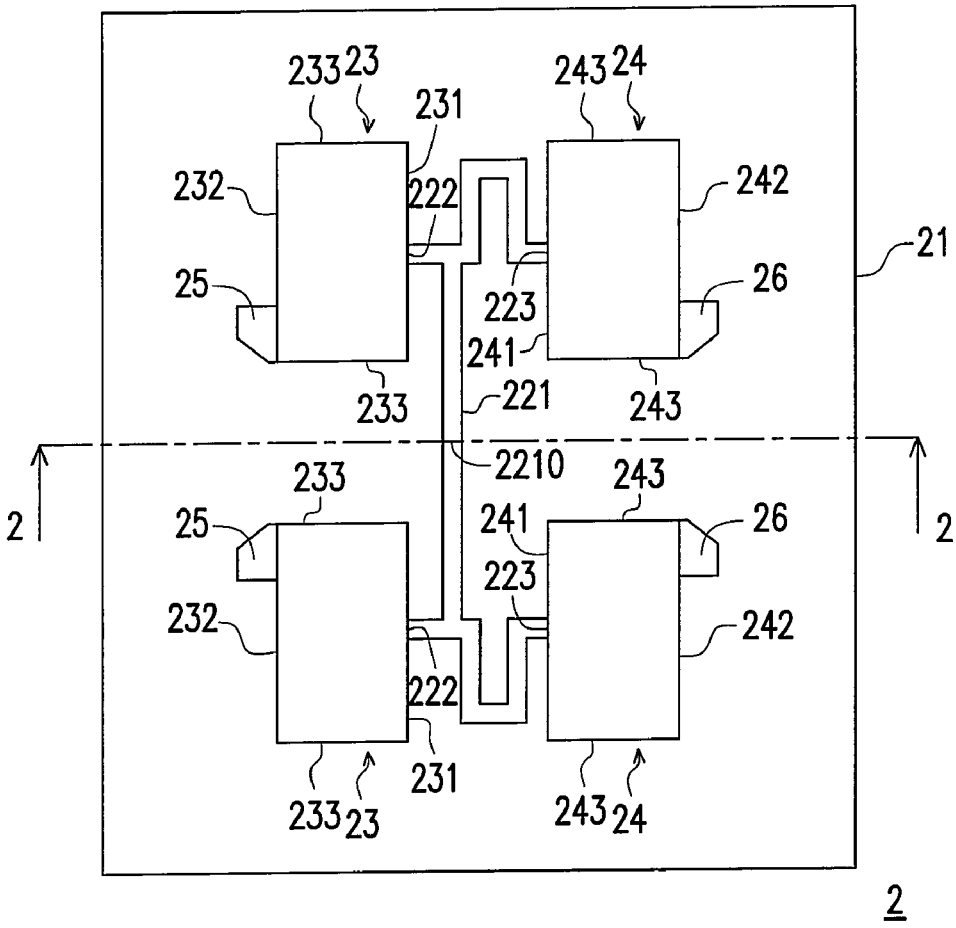
FIG. 1 is a top view showing an antenna array unit according to a first embodiment of the present invention.

The present invention will now be described with reference to the accompanying drawings, in which exemplary embodiments of the invention are shown. The invention may, however, be embodied in many different forms and should not be construed as being limited to the embodiments set forth herein. In the drawings, whenever the same element reappears in subsequent drawings, it is denoted by the same reference numeral.

FIG. 1 is a top view showing an antenna array unit according to a first embodiment of the present invention. An antenna array 2 includes a ground 21, a feeder cable 29 (not shown in FIG. 1, but shown in FIG. 2), a first signal feeding member 221, two second signal feeding members 222, two third signal feeding members 223, two first rectangular radiating members 23 and two second rectangular radiating members 24. The first signal feeding member 221 is connected to the ground 21 through a port 2210 and the feeder cable 29, and has two sides. Each of the plurality of second signal feeding members 222 is connected to the first signal feeding member 221. Further, each of the plurality of the third signal feeding members 223 is connected to the first signal feeding member 221.

Furthermore, the length of the second signal feeding members 222 is shorter than the length of the third feeding members 223 because the difference of length is able to cause the different of phase. The first rectangular radiating members 23 are arranged adjacent to one side of the first signal feeding member 221. The first rectangular radiating members 23 have a first non-radiating side 231, a second non-radiating side 232 and two radiating sides 233, 234. The first non-radiating side 231 is connected to the corresponding second signal feeding members 222. The two radiating sides 233, 234 are connected to both the first and the second non-radiating sides 231, 232, each of the radiating sides 233 able to generate a coupling effect with a radiating side 233 adjacent thereto. Likewise, the second rectangular radiating members 24 are arranged adjacent to the other side of the first signal feeding member 221. The second rectangular radiating members 24 have a first non-radiating side 241, a second non-radiating side 242, and two radiating sides 243. The first non-radiating side 241 is connected to the corresponding second signal feeding members 223. Two radiating sides 243 are connected to the first and the second non-radiating sides 241, 242 and able to generate a coupling effect with a radiating side adjacent thereto.

Specifically, the present invention is characterized in that four surface current disturbing members 25, 26 are formed at each second non-radiating side 232, 242 of the plurality of the first and the second rectangular radiating members 23, 24 and adjacent to the nearest radiating side 233, 243 generating the coupling effect. Particularly, the current disturbing members 25, 26 are formed in pairs and each of the current disturbing members is trapezoid. The first signal feeding member 221, two second signal feeding members 222, two third signal feeding members 223, and the feeder cable 29 form a network. The feeder cable 29 includes a positive signal wire 291, an inner insulative layer 292, a negative signal wire 293, and an outer insulative layer 294. The present invention is effective to eliminate the coupling effect between two neighbor radiating sides of the antenna array, further to reduce the side lobe level.

Figure 2:
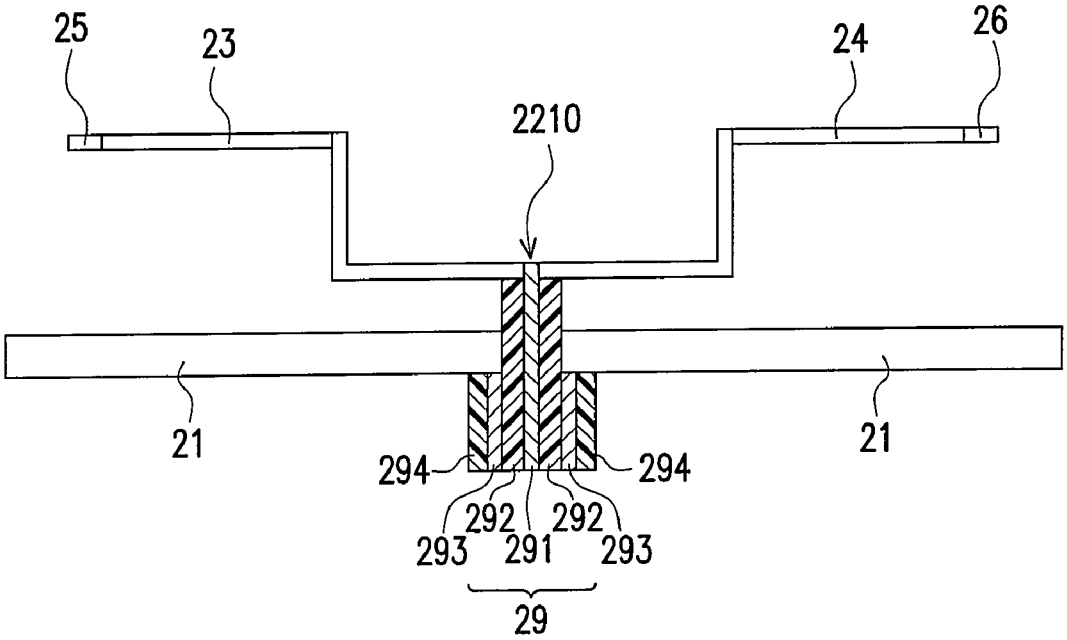
FIG. 2 is a cross-sectional side view, taken along the line 2-2 in FIG. 1, showing the antenna array unit shown in FIG. 1.

FIG. 2 is a cross-sectional side view, taken along the line 2-2 in FIG. 1, showing the antenna array unit shown in FIG. 1. The feeder cable includes a positive signal wire 291, an inner insulative layer 292, a negative signal wire 293, and an outer insulative layer 294. While there exists the ground 21, the positive signal wire 291 of the feeding network is coupled to the first signal feeding member 221, and the negative signal wire 293 is coupled to the ground 21.

Figure 3:
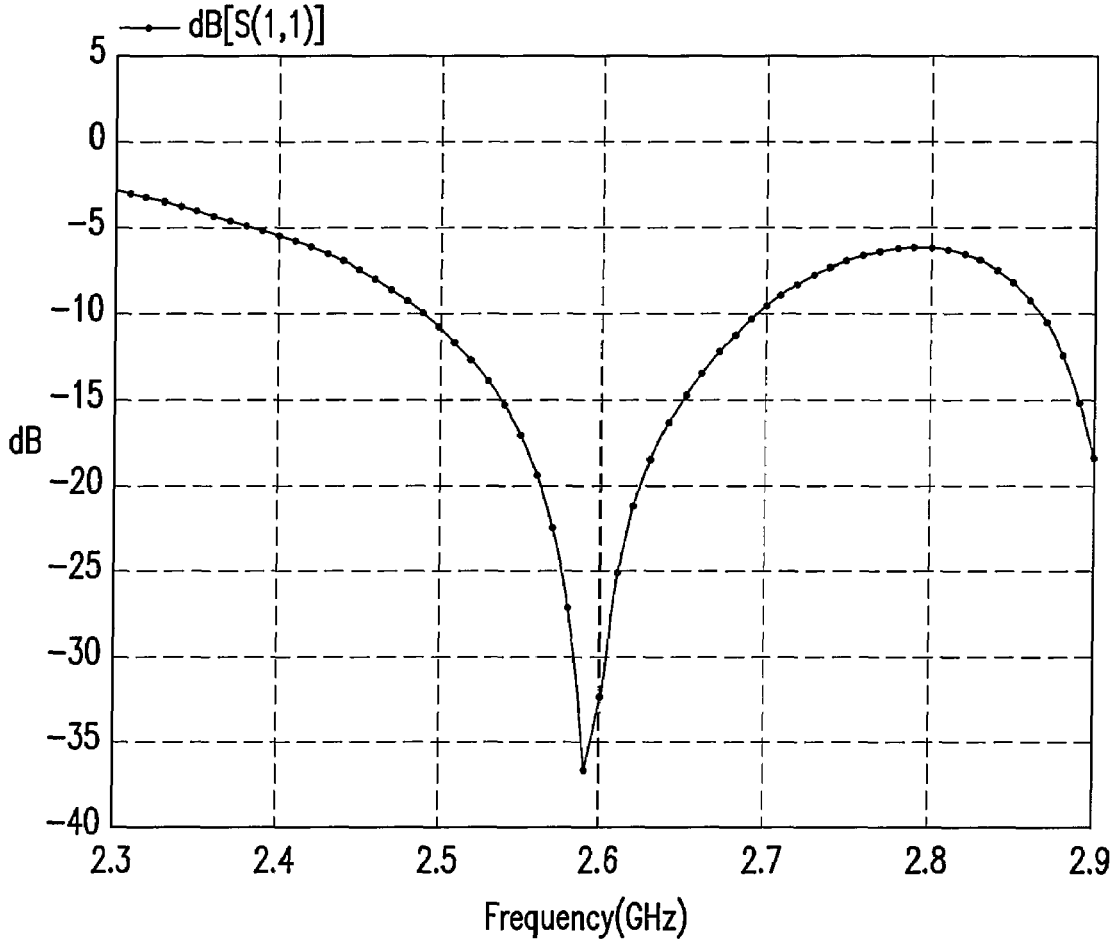
FIG. 3 is a diagram depicting the data collected from a return loss vs. radiation pattern experiment conducted in accordance with the antenna array unit shown in FIG. 1.
Figure 4:
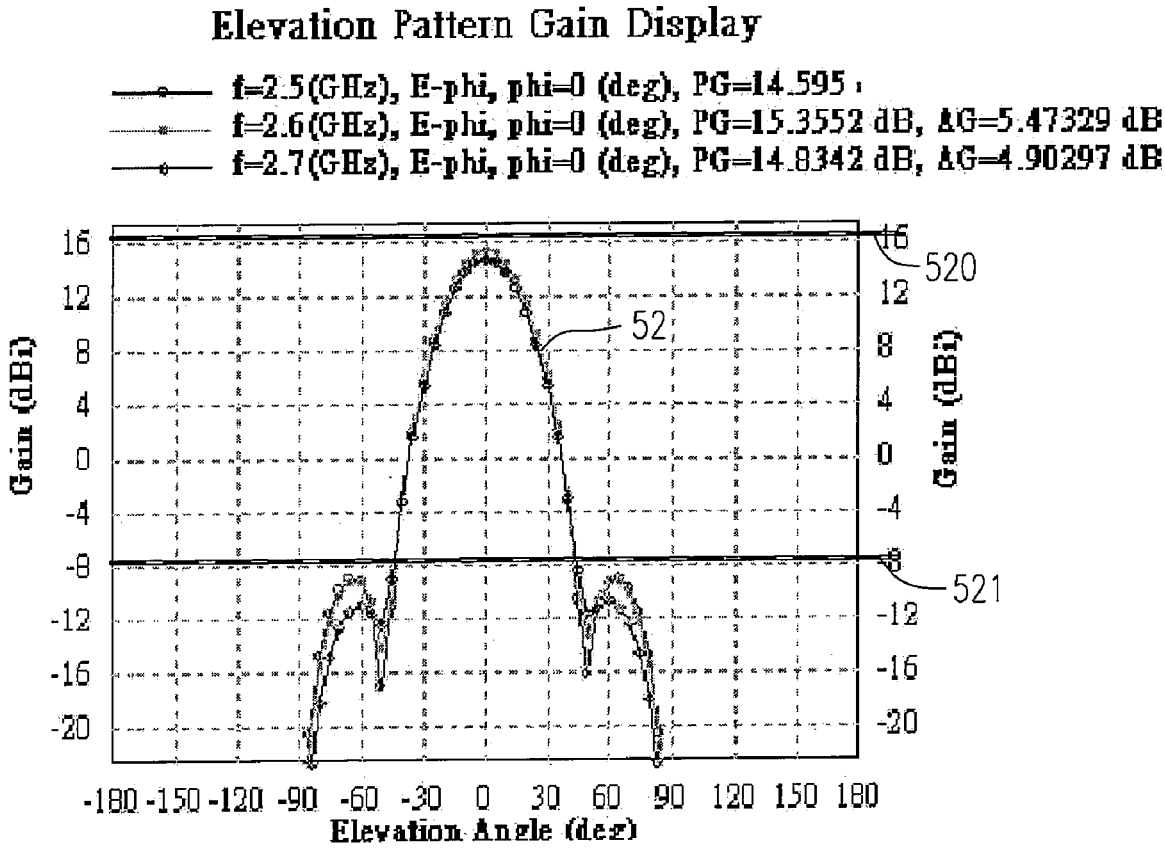
FIG. 4 is a diagram depicting the data collected from a radiation pattern experiment conducted in accordance with the antenna array unit shown in FIG. 1.
Figure 7:
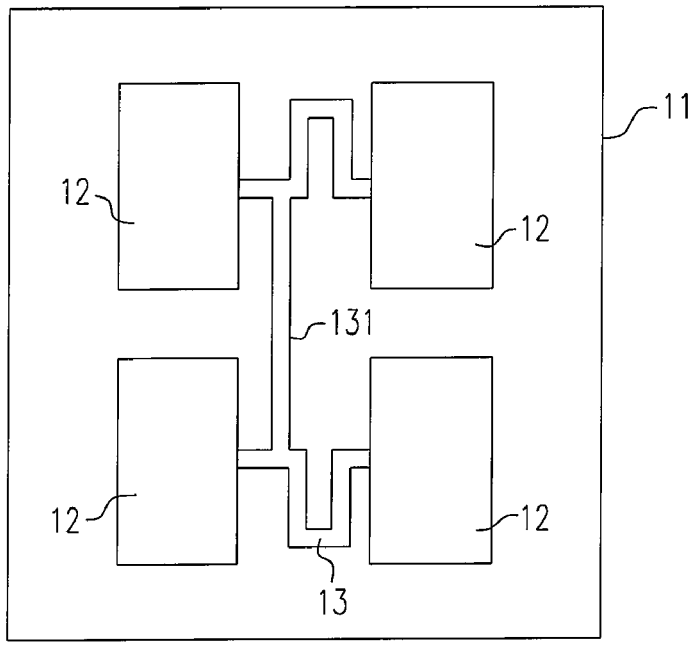
FIG. 7 (PRIOR ART)
FIG. 7 is a top view showing a conventional antenna array unit according to prior art.
Figure 8:
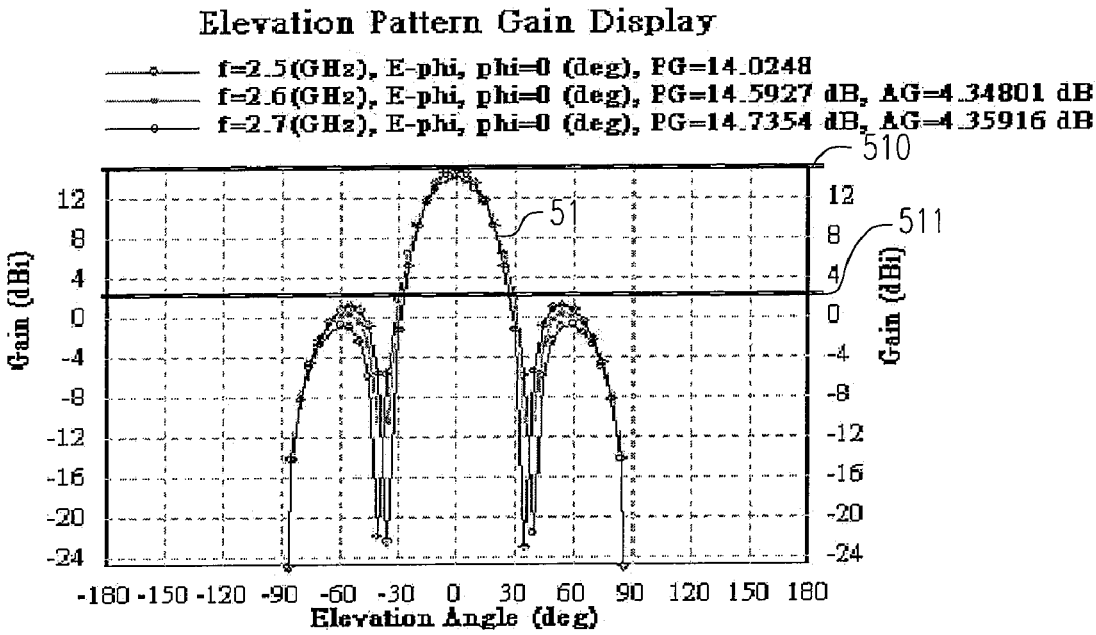
FIG. 8 (PRIOR ART)
FIG. 8 is a diagram depicting the data collected from a radiation pattern experiment conducted in accordance with the antenna array unit shown in FIG. 7.

FIG. 3 is a diagram depicting the data collected from a return loss vs. radiation pattern experiment conducted in accordance with the antenna array unit shown in FIG. 1. FIG. 4 is a diagram depicting the data collected from a radiation pattern experiment conducted in accordance with the antenna array unit shown in FIG. 1, wherein a curve 52 is the experimental result of radiation patterns of a conventional antenna array with the current disturbing members 25, 26. Referring to FIG. 5A, a main lobe gain 510 is about 14 dBi and a side lobe gain is about 2 dBi. Thus, side lobe level is about −12 dBi (2 minus 14 equals −12). FIG. 8 is a diagram depicting the data collected from a radiation pattern experiment conducted in accordance with the antenna array unit shown in FIG. 7, wherein a curve 51 is the experimental result of radiation patterns of a conventional antenna array without the current disturbing members 25, 26. Referring to FIG. 5B, a main lobe gain 520 is still about 16 dBi but a side lobe gain strongly degrades to about −8 dBi. Thus, side lobe level degrades to about −24 dBi. In view of the above results, it is apparent that the side lobe level reduces 12 dBi when the antenna array is arranged with surface current disturbing elements.

Figure 5:
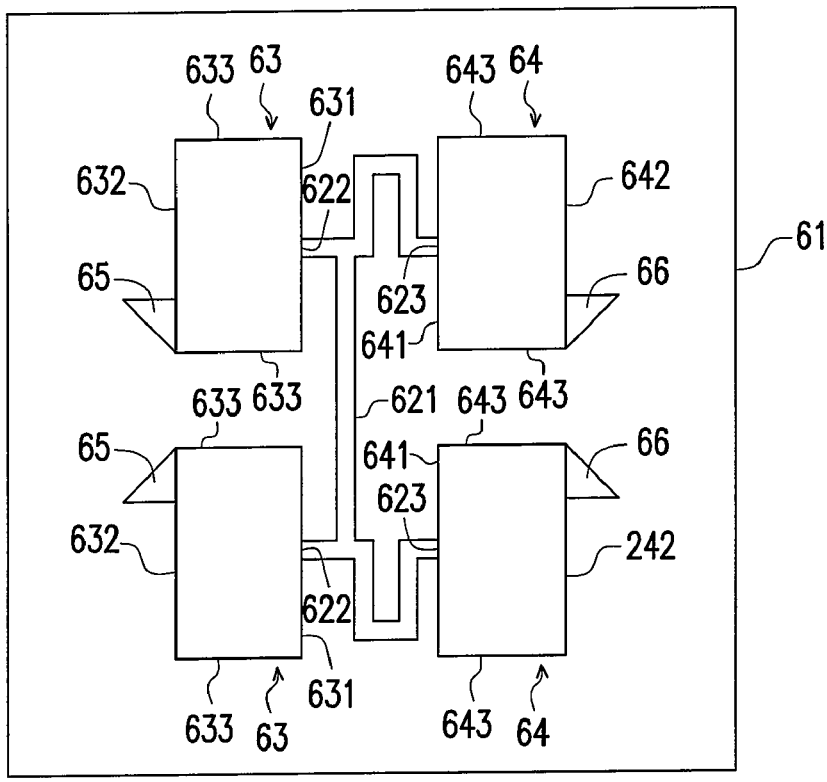
FIG. 5 is a top view showing an antenna array unit according to a second embodiment of the present invention.

FIG. 5 is a top view showing an antenna array unit according to a second embodiment of the present invention. The antenna array includes: a ground 61, a first signal feeding member 621, two second signal feeding members 622, two third signal feeding members 623, two first rectangular radiating members 63 and two second rectangular radiating members 64.

Furthermore, first rectangular radiating members 63 are arranged adjacent to a side of the first signal feeding member 621. The first rectangular radiating members 63 have a first non-radiating side 631, a second non-radiating side 632 and two radiating sides 633, 634. The first non-radiating side 631 is connected to the corresponding second signal feeding member 622. The two radiating sides 633, 634 are connected to both the first and the second non-radiating sides 631, 632, each of the radiating sides 633 able to generate a coupling effect with a radiating side 633 adjacent thereto. Similarly, the second rectangular radiating members 64 are arranged adjacent to the other side of the first signal feeding member 621. The second rectangular radiating members 64 have a first non-radiating side 641, a second non-radiating side 642, and two radiating sides 643. The first non-radiating side 641 is connected to the corresponding second signal feeding members 623. Two radiating sides 643 are connected to the first and the second non-radiating sides 641, 642 and able to generate a coupling effect with a radiating side adjacent thereto.

Specifically, the present invention is characterized in that four surface current disturbing members 65, 66 are formed at each second non-radiating side 632, 642 of the plurality of the first and the second rectangular radiating members s 63, 64 and adjacent to the nearest radiating side 633, 643 generating the coupling effect. Particularly, the current disturbing members 65, 66 are formed in pairs and each of the current disturbing members is trapezoid. The first signal feeding member 621, two second signal feeding members 622, two third signal feeding ports 623, and a feeder cable (not shown)form a network. The present invention is effective to eliminate the coupling effect between two neighbor radiating sides of the antenna array, further to reduce the side lobe level.

Those skilled in the art should understand that the surface current disturbing members 65, 66 are not only limited to be triangular or trapezoid, but also be polygonal.

Figure 6:
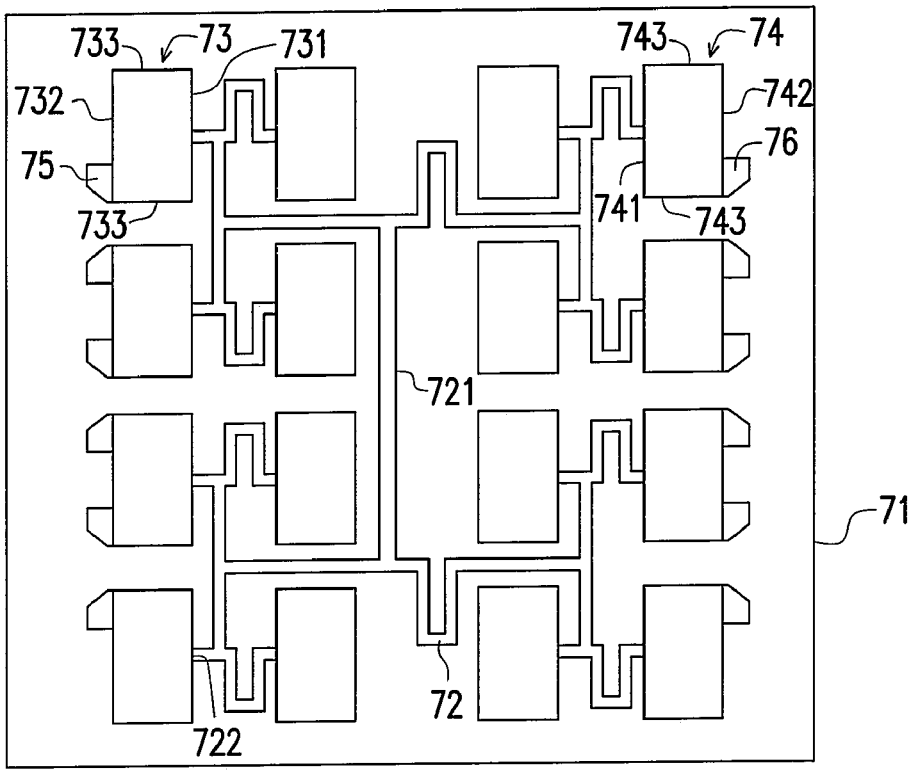
FIG. 6 is a top view showing an antenna array unit according to a third embodiment of the present invention.

FIG. 6 is a top view showing an antenna array unit according to a third embodiment of the present invention. The antenna array includes: a ground 71, a first signal feeding member 721, eight second signal feeding members 722, eight third signal feeding members 723, eight first rectangular radiating members 63 and eight second rectangular radiating members 74.

Furthermore, the first rectangular radiating members 73 are arranged adjacent to a side of the first signal feeding member 721. The first rectangular radiating members 23 have a first non-radiating side 731, a second non-radiating side 732 and two radiating sides 733, 734. The first non-radiating side 731 is connected to the corresponding second signal feeding member 722. The two radiating sides 733, 734 are connected to both the first and the second non-radiating sides 731, 732, each of the radiating sides 733 able to generate a coupling effect with a radiating side 733 adjacent thereto. Similarly, the second rectangular radiating plates 74 are arranged adjacent to the other side of the first signal feeding member 721. The second rectangular radiating members 74 have a first non-radiating side 741, a second non-radiating side 742, and two radiating sides 743. The first non-radiating side 741 is connected to the corresponding second signal feeding members 723. Two radiating sides 743 are connected to the first and the second non-radiating sides 741, 742 and able to generate a coupling effect with a radiating side adjacent thereto.

Specifically, the present invention is characterized in that four surface current disturbing members 75, 76 are formed at each second non-radiating side 732, 742 of the plurality of the first and the second rectangular radiating members 73, 74 and adjacent to the nearest radiating side 733, 743 generating the coupling effect. Particularly, the current disturbing members 75, 76 are formed in pairs and each of the current disturbing members is trapezoid. The first signal feeding member 721, two second signal feeding members 722, two third signal feeding members 723 and a feeder cable (not shown) form a network. The present invention is effective to eliminate the coupling effect between two neighbor radiating sides of the antenna array, further to reduce the side lobe level.

Though the present invention has been disclosed above by the preferred embodiments, they are not intended to limit the invention. Anybody skilled in the art can make some modifications and variations without departing from the spirit and scope of the invention. Therefore, the protecting range of the invention falls in the appended claims.

What is claimed is:

1. An antenna array unit comprising:

a ground;

a feeder cable;

a first signal feeding member connected to the ground and the feeder cable, and having two sides;

a plurality of second signal feeding members, each connected to the first signal feeding member;

a plurality of third signal feeding members, each connected to the first signal feeding member;

a plurality of first rectangular radiating members arranged adjacent to one side of the first signal feeding member, each having a first non-radiating side connected to the corresponding second signal feeding member, a second non-radiating side, and two radiating sides, each respectively connected to the first and the second non-radiating sides and able to generate a coupling effect with the nearest radiating side adjacent thereto; and a plurality of second rectangular radiating members arranged adjacent to the other side of the first signal feeding member, each having a first non-radiating side connected to the corresponding second signal feeding member, a second non-radiating side, and two radiating sides, each respectively connected to the first and the second non-radiating sides and able to generate a coupling effect with the nearest radiating side adjacent thereto;

which is characterized in that at least one current disturbing member is formed at each second non-radiating side of the plurality of the first and the second rectangular radiating members and adjacent to the nearest radiating side generating the coupling effect.

2. The antenna array unit according to claim 1, wherein all the current disturbing members formed in pairs.

3. The antenna array unit according to claim 1, wherein each of the current disturbing members is polygonal.

4. The antenna array unit according to claim 3, wherein each of the current disturbing members is triangular.

5. The antenna array unit according to claim 3, wherein each of the current disturbing members is trapezoid.

6. The antenna array unit according to claim 2, wherein the first signal feeding member, the plurality of second signal feeding members, and the plurality of third signal feeding members and a feeder cable form a network.

* * * * *